US006417627B1

(12) United States Patent
Derraa

(10) Patent No.: US 6,417,627 B1
(45) Date of Patent: Jul. 9, 2002

(54) MATRIX-ADDRESSABLE DISPLAY WITH MINIMUM COLUMN-ROW OVERLAP AND MAXIMUM METAL LINE-WIDTH

(75) Inventor: Ammar Derraa, Boise, ID (US)

(73) Assignee: Micron Technology, Inc., Boise, ID (US)

( * ) Notice: Subject to any disclaimer, the term of this patent is extended or adjusted under 35 U.S.C. 154(b) by 0 days.

(21) Appl. No.: 09/243,929

(22) Filed: Feb. 3, 1999

(51) Int. Cl.[7] ..... G09G 3/10

(52) U.S. Cl. ..... 315/169.3; 315/169.1; 313/500; 345/75.2

(58) Field of Search ..... 315/169.3, 169.1, 315/169.4; 313/293, 310, 500; 445/24; 345/76, 74, 75.2

(56) References Cited

U.S. PATENT DOCUMENTS

| | | | | | |
|---|---|---|---|---|---|
| 5,194,780 | A | * | 3/1993 | Meyer | 315/169.3 |
| 5,541,466 | A | * | 7/1996 | Taylor et al. | 313/310 |
| 5,550,435 | A | | 8/1996 | Kuriyama et al. | 315/169.1 |
| 5,577,944 | A | | 11/1996 | Taylor | 445/25 |
| 5,598,057 | A | | 1/1997 | Vickers | 313/495 |
| 5,655,940 | A | | 8/1997 | Hodson et al. | 445/24 |
| 5,663,608 | A | | 9/1997 | Jones et al. | 313/309 |
| 5,689,278 | A | | 11/1997 | Barker et al. | 345/74 |
| 5,727,977 | A | | 3/1998 | Maracas et al. | 445/24 |
| 5,754,149 | A | | 5/1998 | Browning et al. | 345/75 |
| 5,759,078 | A | * | 6/1998 | Levine et al. | 445/24 |
| 5,760,535 | A | | 6/1998 | Moyer et al. | 313/309 |
| 5,763,997 | A | | 6/1998 | Kumar | 313/495 |
| 5,767,619 | A | | 6/1998 | Tsai et al. | 313/495 |
| 5,814,925 | A | * | 9/1998 | Tomihari | 313/309 |

* cited by examiner

*Primary Examiner*—Don Wong
*Assistant Examiner*—Ephrem Alemu
(74) *Attorney, Agent, or Firm*—Dorsey & Whitney LLP

(57) ABSTRACT

A matrix-addressable device includes a number of metal column lines having a number of windows underlying locations of intersection where a number of metal row lines overlap or cross the column lines. Each of the windows has a length that is greater than the nominal width of the row line crossing the column line. A layer of a doped semiconductor overlaps each of the windows to electrically couple a number of emitters formed on the doped semiconductor to the column lines. Each of the metal row lines may include a number of windows positioned at the locations where the row and column lines overlap. Each of the windows has a length greater than a nominal width of the column line that the window overlays. A doped semiconductor layer covers each of the windows and is electrically coupled thereto. A number of apertures formed in the doped semiconductor layer aligned with the emitters to form an extraction grid. A layer of dielectric material may separate the column lines from the row lines.

52 Claims, 7 Drawing Sheets

MATRIX-ADDRESSABLE DISPLAY WITH MINIMUM COLUMN-ROW OVERLAP AND MAXIMUM METAL LINE-WIDTH

This invention was made with United States Government support under Contract No. DABT63-97-C-0001 awarded by Advanced Research Projects Agency (ARAP). The United States Government has certain rights in this invention.

TECHNICAL FIELD

The present invention relates to matrix-addressable displays, and more particularly, to column and row line formation of control circuits in matrix-addressable displays.

BACKGROUND OF THE INVENTION

Matrix-addressable display are widely used in a variety of applications, including computer displays. One type of display well suited for such applications is the field emission display. Field emission displays typically include a generally planar baseplate positioned beneath a faceplate. The baseplate includes a substrate having an array of emitters. Usually, the emitters are conical projections integral to the substrate and grouped into commonly connected emitter sets.

The baseplate also includes a conductive extraction grid positioned above the emitters and driven with a voltage of about 30–120 volts. The emitters are selectively activated by providing electrons to the emitters, for example by grounding the emitters. If the voltage differential between the emitters and the extraction grid is sufficiently high, the resulting electric field extracts electrons from the emitters.

The faceplate is mounted adjacent the extraction grid and includes a transparent display screen coated with a transparent conductive material to form an anode that is generally biased to about 1–2 kV. A cathodoluminescent layer covers the exposed surface of the anode. Electrons emitted by the emitters are attracted by the anode and strike the cathodoluminescent layer, causing the cathodoluminescent layer to emit light at the impact site. The emitted light then passes through the anode and the glass plate where it is visible to a viewer. The brightness of the pixel produced in response to the emitted electrons depends, in part, upon the number of electrons striking the cathodoluminescent layer in an activation interval, which in turn depends upon the current flow from the emitters. The brightness of each pixel can thus be controlled by controlling the current flow from the respective emitter or emitter set. The light from each area of the display can thus be controlled to produce an image. The light emitted from each of the areas thus becomes all or part of a picture element or "pixel."

In practice, the emitters are usually arranged in columns, while individual extraction grids are arranged in rows. An individual emitter can then be selected for electron emission by driving a column of emitters to a relatively low voltage and driving an extraction grid row to a relatively high voltage. Electrons are emitted from the emitter in the energized column of emitters that intersects with the energized extraction grid row.

The columns of emitters and the rows of extraction grids are typically driven by metal column lines and row lines, respectively, formed on a single substrate. Usually, the column lines and row lines are formed at right angles to one another. The column lines in a first plane are spaced from the row lines in a second plane and separated from each other by a layer of dielectric material. The emitters are may be formed at the points of intersection where the column lines and row lines cross. The column and row lines and intermediate dielectric produces a capacitive effect leading to relatively large RC time constants in the drive circuit.

SUMMARY OF THE INVENTION

The present invention is directed to apparatus and methods in matrix-addressable displays for reducing the overlap between conductive portions of the column and row lines while maintaining the nominal widths of the conductive lines.

In one aspect of the invention, the matrix-addressable display includes a number of conductive column lines, each having a number of windows or openings. A window underlies each intersection where a conductive row line overlaps or crosses the column line. Each of the windows has a width that is less than the width of the column line and a length that may be greater than the nominal width of the row line crossing the column line. A conductive layer of a doped semiconductor, such as doped polysilicon, overlaps each of the windows and is electrically coupled to the column line. The doped semiconductor may carry a number of emitters and provides a current path between the emitters and the column lines.

In another aspect of the invention, the matrix-addressable display includes a number of conductive row lines spaced from and crossing or intersecting the column lines at a number of locations. Each of the row lines includes a number of windows or openings. The windows may be positioned at each location where the row and column lines overlap. Each of the windows or openings may have a length greater than a nominal width of the column line that the window overlays. A conductive, doped semiconductor layer overlaps each of the windows in the row line and is electrically coupled thereto. A number of apertures may be formed in the doped semiconductor layer, each of which is aligned with ones of the respective emitters to form an extraction grid.

A layer of dielectric material may separate the semiconductor supporting the emitters and the row lines to space the row lines from the doped semiconductor carrying the emitters and to electrically isolate the column lines from the row lines.

The windows in the row and column lines may be sized, dimensioned, and positioned to reduce the area of overlap of the metal portions of the column and row lines while maintaining the nominal widths of the lines. Thus, the RC time constant may be reduced where resistance is inversely proportional to line width and capacitance is directly proportional to overlap area.

DETAILED DESCRIPTION OF THE INVENTION

In the following description, certain specific details are set forth in order to provide a thorough understanding of various embodiments of the invention. However, one skilled in the art will understand that the invention may be practiced without these details. In other instances, well known structures associated with matrix-addressable devices and semiconductor fabrication methods have not been shown or described in detail to avoid unnecessarily obscuring the description of the embodiments of the invention.

Figure 1:
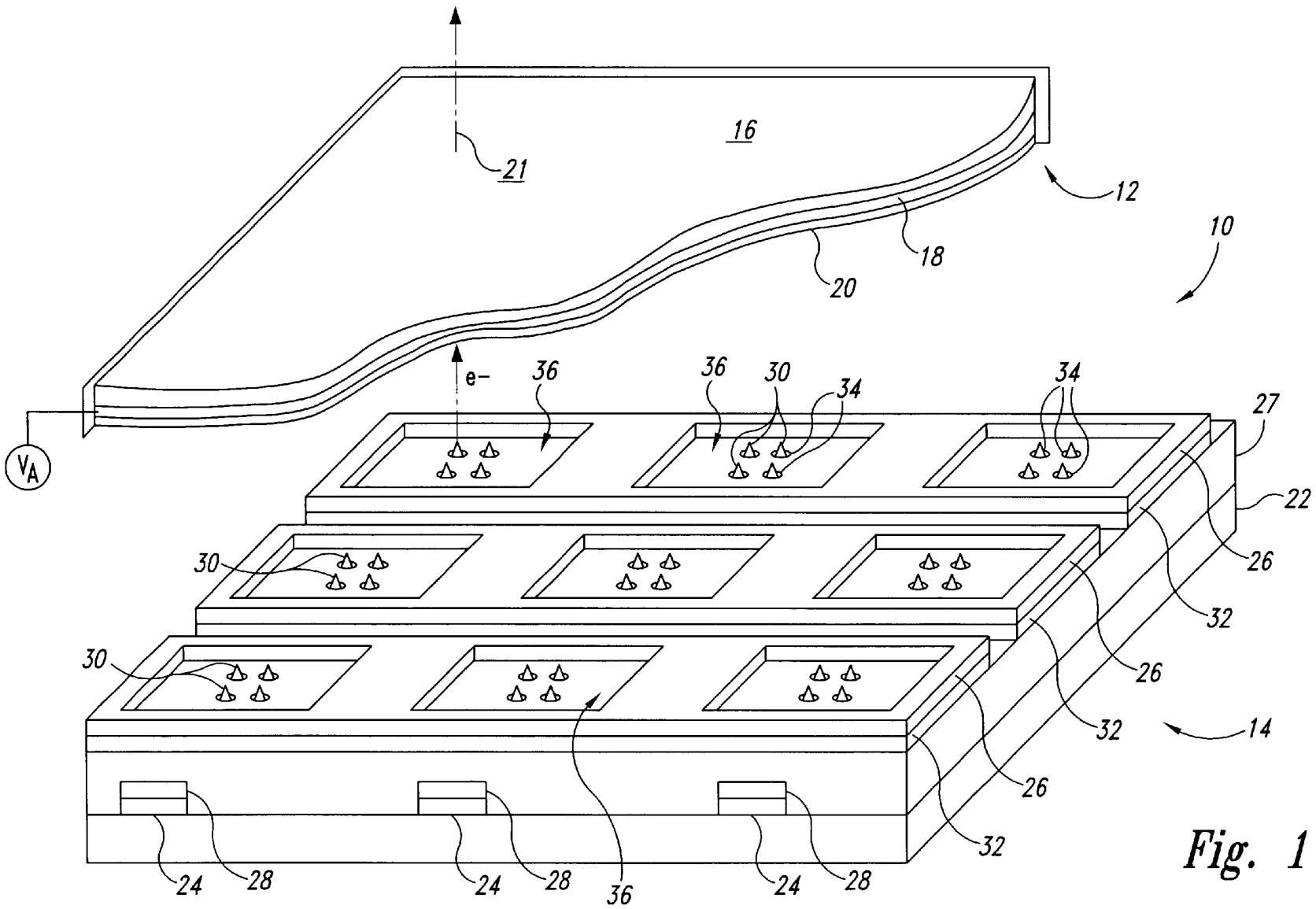
FIG. 1 is a isometric view of a field emission display according to an exemplary embodiment of the invention.

FIG. 1 shows a matrix-addressable device in the form of a field mission display 10, including a faceplate 12 and a backplate 14. The faceplate 12 is mounted adjacent the backplate 14 and includes a display screen formed from a glass plate 16 coated with a transparent conductive material 18 to form an anode that may be biased to approximately 1–2 kV. A cathodoluminescent layer 20 covers the exposed surface of the anode. The cathodoluminescent layer emits a photon 21 in response to being struck by electrons $e^-$. The emitted light passes through the anode and the glass plate 16 to be visible to a viewer.

The backplate 14 includes a substrate 22 on which the microelectronic structure is formed. The backplate 14 includes a number of columns and rows selected through column lines 24 and row lines 26. The column lines 24 and row lines 26 are preferably formed of a conductive metal suitable for silicon fabrication processes, although they may also be fabricated from another conductive material. For example, the column and row lines 24, 26 may be aluminum, tungsten, or copper.

While in the Figures, the column lines 24 are shown as extending between the top and the bottom of the page, and the row lines 26 extending between right and left hand margins, the terms column and row are interchangeable. Thus, the columns lines 24 may have been shown as extending across the page, while the row lines 26 may have been shown running up and down the page. Further, the column and rows lines 24, 26 do not necessarily have to be at right angles to one another.

Conductive emitter pads 28 of doped polysilicon may be disposed over portions of the column lines 24 to support emitters 30. The emitter pads 28 electrically couple the emitters 30 to the column lines 24. The polysilicon of the emitter pads 28 may be appropriately doped such that the emitter pads 28 form current limiting resistors for the respective emitters 30 formed thereon. For example, the polysilicon may be doped with between approximately 10 ppm and about 100 ppm of boron. Alternatively, the polysilicon may be doped with approximately 1 ppm and 10 ppm of phosphorous. In a further alternative embodiment, the polysilicon may be doped with approximately 1 ppm and approximately 10 ppm of arsenic.

The emitters 30 in each set have their bases commonly connected. While FIG. 1 shows four emitters 30 in each set, the display 10 may include any number of emitters 30 in a set. For convenience and clarity of presentation, generally only one emitter will be discussed herein. However, one skilled in the relevant art will understand that references to the emitter may refer to any number of commonly connected emitters.

A number of conductive polysilicon extraction grid strips 32, having apertures 34 formed therethrough serve as an extraction grid to excite electron emission from the emitters 30. A 30–60 volt difference between the emitters 30 and the extraction grid strips 32 is typically sufficient to excite electron emission. Openings or windows 36 formed in the row lines 26 provide a free path for the flow of electrons $e^-$ from the emitters 30 to the anode 18, as well as providing other benefits described below. A layer of dielectric material 27 separates the column lines 24 and emitter pads 28 from the extraction grid strips 32.

Figure 2:
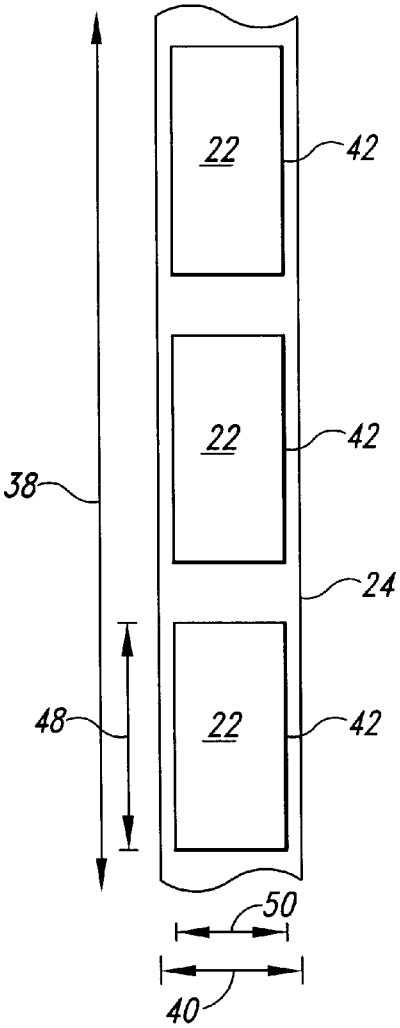
FIG. 2 is a top plan view of a column line of FIG. 1.

FIG. 2 shows the column line 24 as a conductive metal trace formed on the substrate 22. The column line 24 has a length 38 and a nominal width 40. The column line 24 includes a number of windows 42 spaced at intervals along the length 38 of the column line 24. The windows 42 are shown as rectangular, although the windows 42 may have any suitable shape and size that reduces the area of metal-metal overlap. As shown, each of the windows 42 have a length 48 and a width 50.

Figure 3:
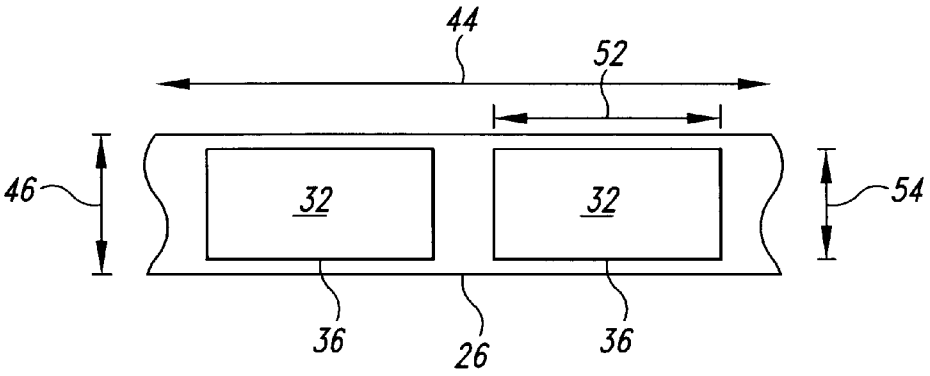
FIG. 3 is a top plan view of a row line of FIG. 1.

FIG. 3 shows the row line 26 formed as a conductive metal trace formed on the conductive strip 32. The row line 26 has a length 44 and a nominal width 46. The row line 26 includes a number of windows 36 spaced at intervals along the length 44 of the row line 26. Again, the windows 36 are shown as rectangular, although the windows 36 may also have any suitable shape and size that reduces the area of metal-metal overlap. As shown, each of the windows 36 have a length 52 and a width 54.

Figure 4:
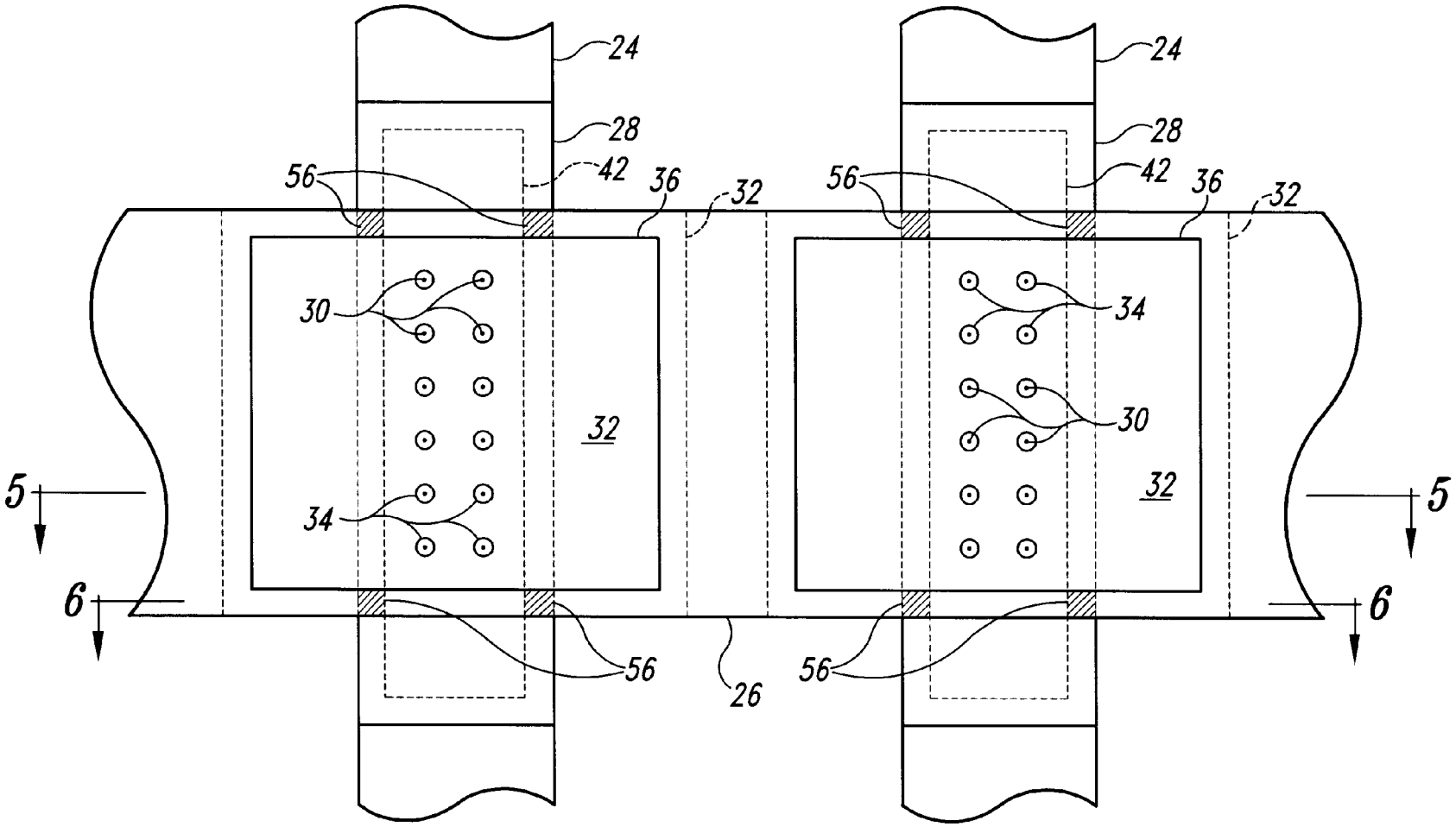
FIG. 4 is a top plan view of a row line overlying a pair of column lines.

FIG. 4 shows a row line 26 overlying a pair of column lines 24. The length 48 of the window 42 in the column line 24 is greater than the nominal width 46 of the row line 26. Similarly, the length 52 of the window 36 in the row line 26 is greater than the nominal width 40 of the column line 24. Thus, as can be seen in FIG. 4, the area of metal-metal overlap of the row line 26 and column lines 24 is minimized, as indicated by the cross-hatched areas 56.

Figure 5:
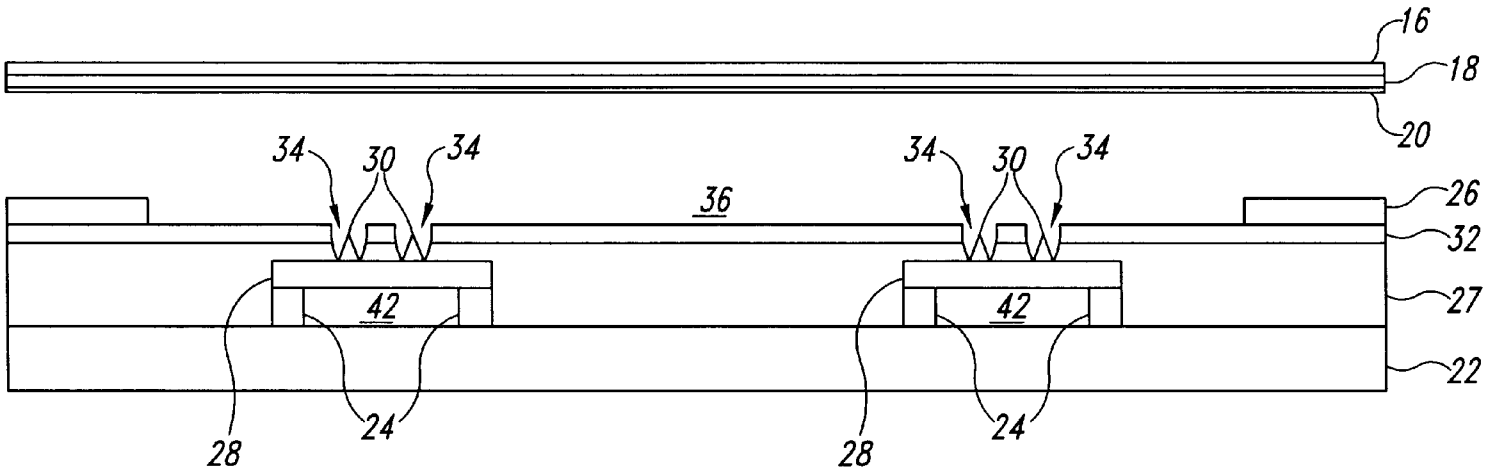
FIG. 5 is a cross-sectional view taken along section line 5 of FIG. 4.

FIG. 5 shows a cross section of the row line 26 and column lines 24 taken through section line 5—5 of FIG. 4. In particular, FIG. 5 shows the window 42 defined between legs of the column line 24. FIG. 5 further shows the apertures 34 in the extraction grid strip 32 aligned with the emitters 30. One skilled in the art will notice that the dielectric layer 27 has been etched away around the base of the emitters 30 to further expose the emitters 30.

Figure 6:
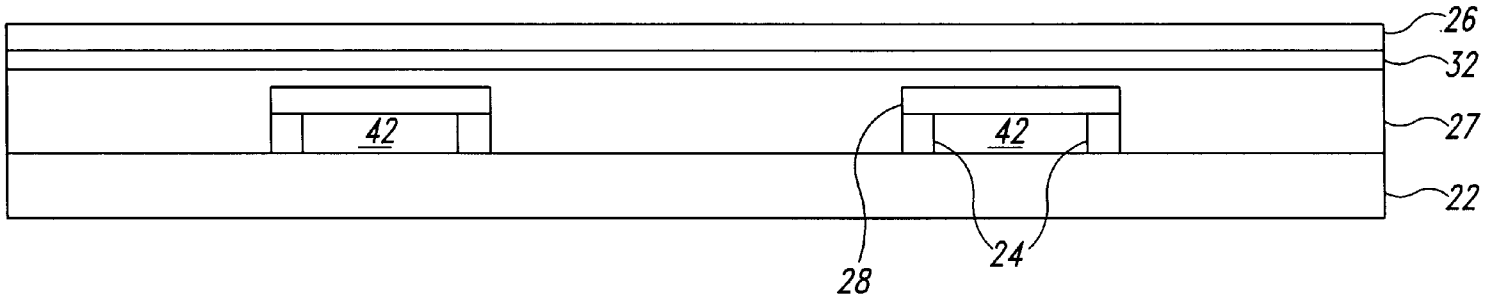
FIG. 6 is a cross-sectional view taken along section line 6 of FIG. 4.

FIG. 6 is a cross-sectional view of the row line 26 and column lines 24 taken through section line 6—6 of FIG. 4. It may be noted that the window 36 does not appear in FIG. 6, the section being taken through one of the legs of the row line 26.

Figure 7:
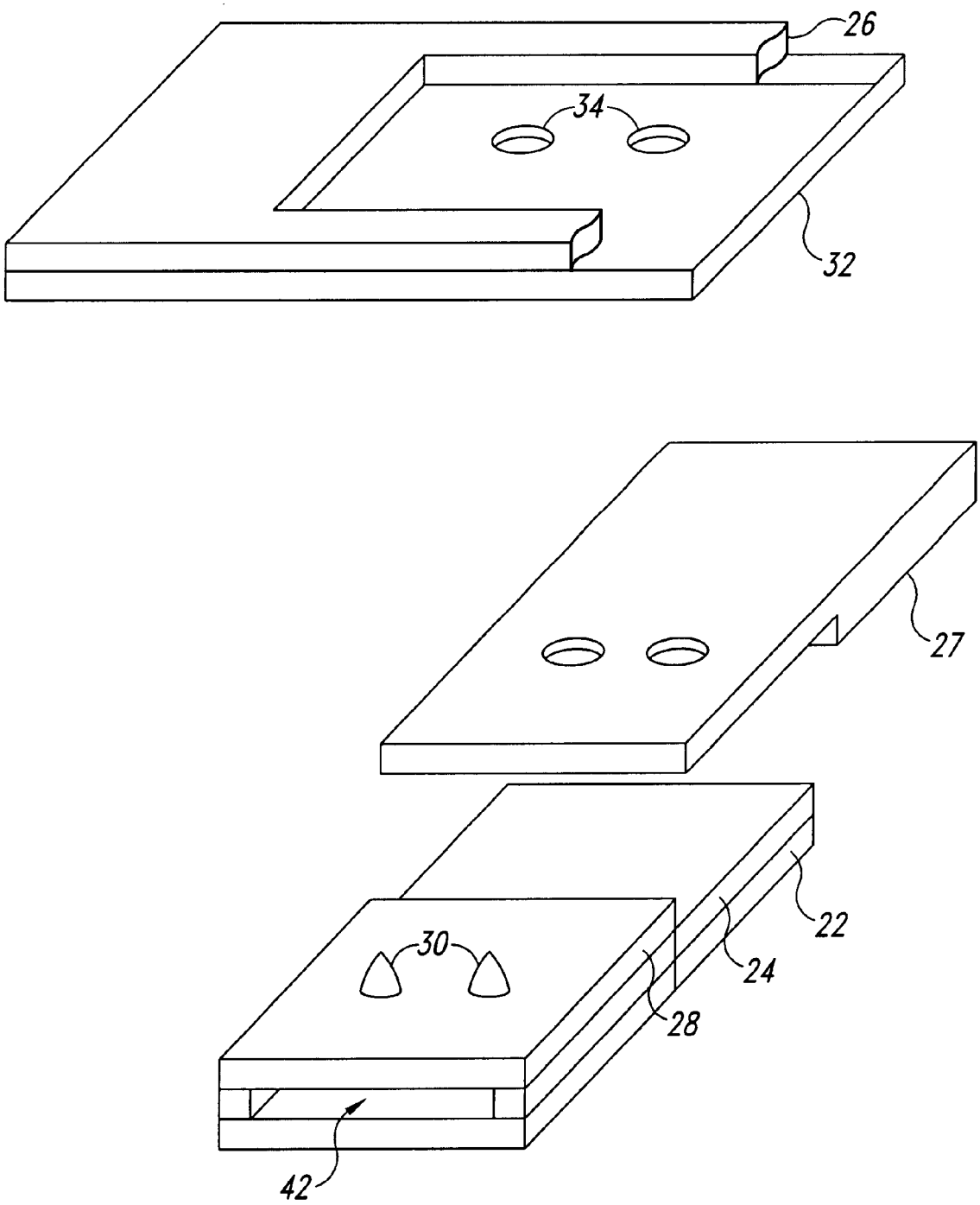
FIG. 7 is an exploded view of the component layers of the field emission display.

FIG. 7 shows an exploded view of a column line 24 and row line 26 of the display 10 of FIG. 1. The dielectric layer 27 conforms to the column line 24 and emitter pad 28. The dielectric layer 27 provides support and electrical isolation to the extraction grid strip 32. The window 42 in the column line 24 is clearly visible in this partial, exploded view.

Figure 9:
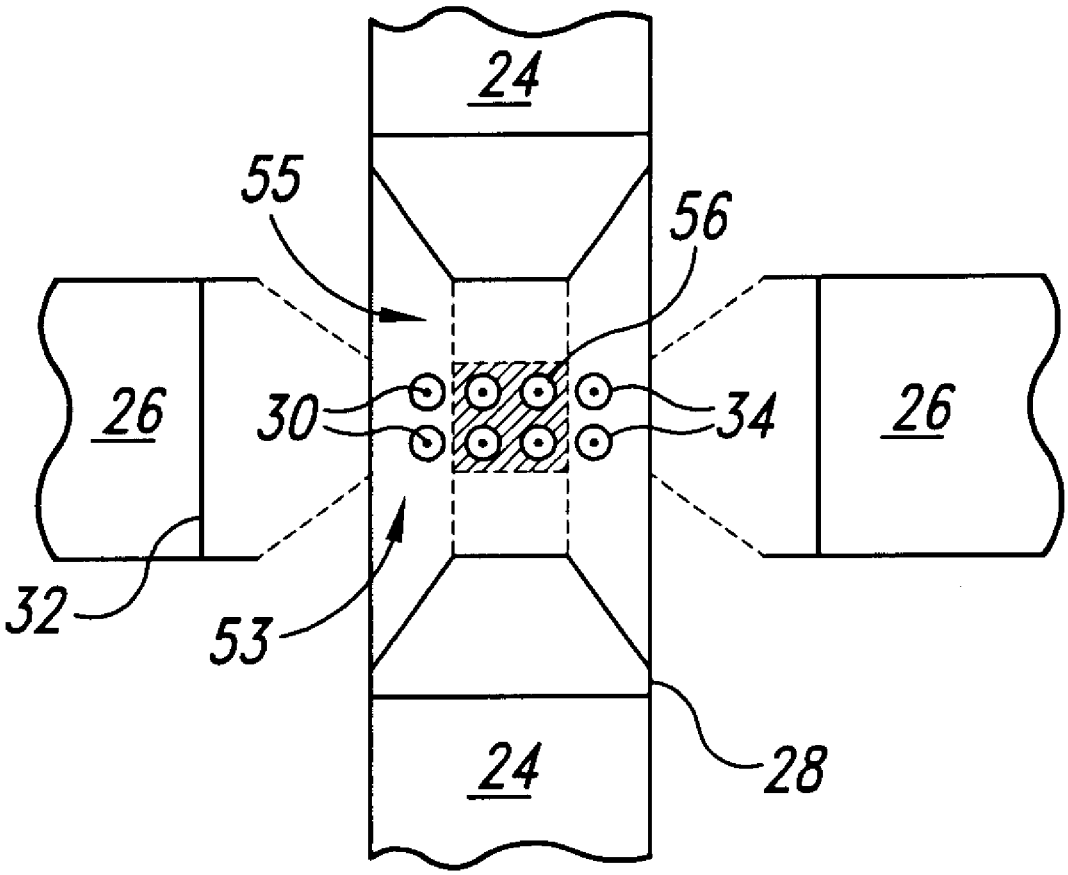
FIG. 9 is a top plan view of a row line having a necked region overlying a column line having a necked region.

FIG. 9 shows a row line 26 overlying a column line 24. The row line 26 has a necked region 53 in the area where the row line 26 crosses the column line 24. Similarly, the column line has a necked region 55 in the area where the lines cross. Thus, as can be seen in FIG. 9, the area of overlap of the row line 26 and column lines 24 is minimized, as indicated by the cross-hatched area 56.

Figure 8:
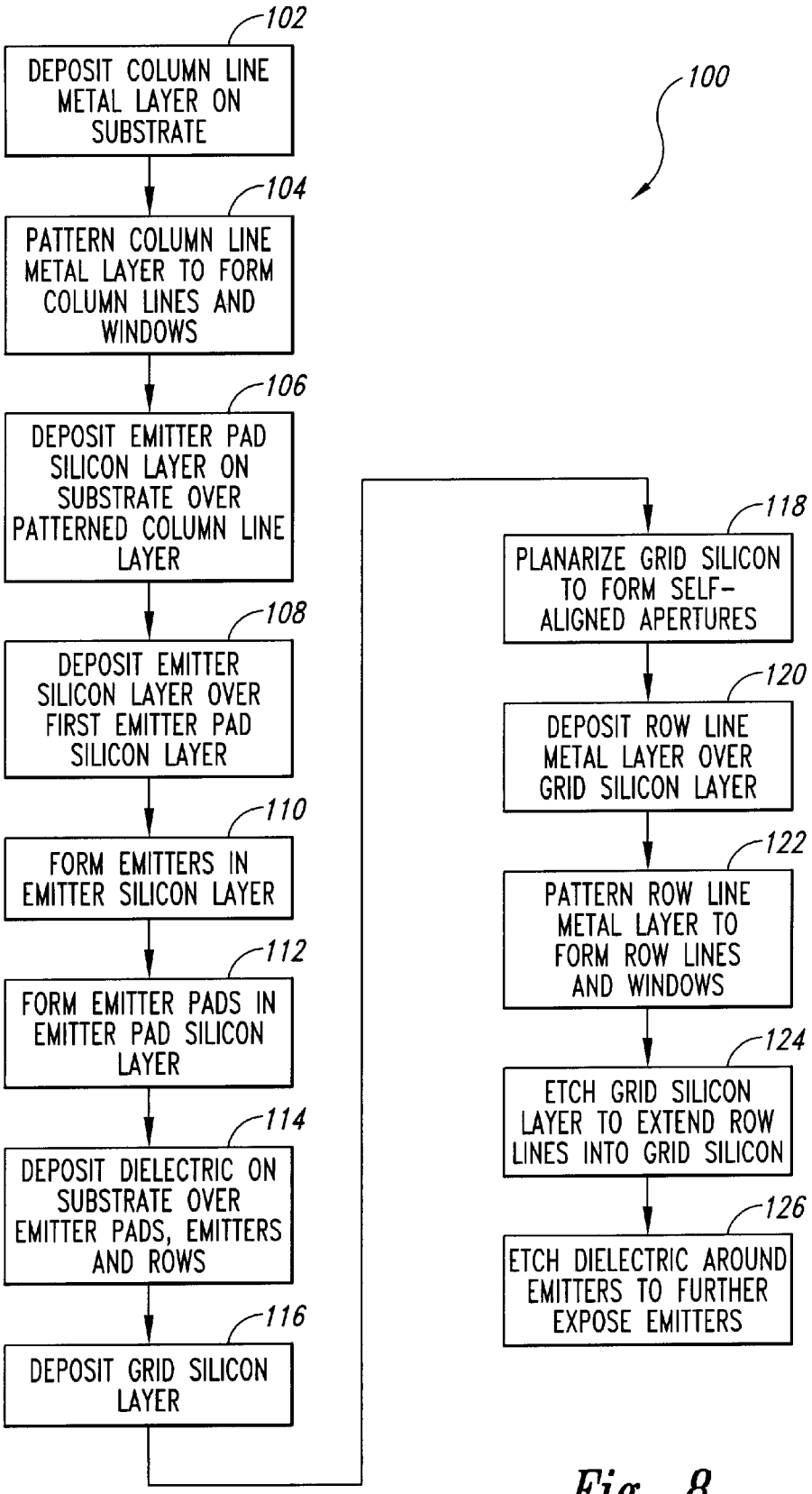
FIG. 8 is a flowchart of an exemplary method of forming the field emission display of FIG. 1.

FIG. 8 describes an exemplary method 100 of forming the display 10 of FIG. 1. In step 102, a column line metal layer is deposited on the surface of the substrate 22. As discussed above, the column line layer may be any metal or other conductor suitable for the silicon fabrication process. In step 104, the column line metal layer is patterned to form the column lines 24 and the windows 42. Patterning may be accomplished through conventional patterning steps, such as masking followed by a dry etch.

In step 106, an emitter pad layer is deposited on the substrate over the patterned column line layer. The emitter pad layer is composed of a conductive material, preferably a doped polysilicon. The polysilicon may be doped to achieve a desired resistance such that the emitter pads 28 will serve as current limiting resistors for the respective emitters 30.

In step 108, an emitter layer is deposited over the emitter pad layer. The emitter layer comprises a conductive material such as polysilicon and is preferably doped to have a lower resistance than the emitter pad layer. In step 110, emitters 30 are formed in the emitter layer. Emitters 30 may be formed through standard dry etching processes, although wet etching techniques and other techniques for forming emitters may be employed. In step 112, the emitter pads 28 are formed in the emitter pad layer. Again, conventional patterning steps may be suitable for emitter pad formation, such as masking and dry etching.

In step 114, a dielectric 27 is deposited on the resulting substrate over the emitter pads 28, emitters 30, and exposed portions of the row lines 24. The dielectric 27 serves as a support for further deposition and as electrical insulation between the column lines 24 and the row lines 26.

In step 116, a grid layer is deposited over the dielectric layer 27. The grid layer is preferably a doped polysilicon. In step 118, the grid layer is planarized to form apertures 34 that are self aligned to the emitters 30. Chemical-mechanical planarization may be employed as taught in U.S. Pat. No. 5,186,670 issued Feb. 16, 1993 to Doan et al. In step 120, a row line layer is deposited over the planarized grid layer. The row line layer is preferably formed from a metal that is compatible with the other silicon fabrication processing steps.

In step 122, the row line layer is patterned to form the row lines 26 and windows 36. In step 124, the grid layer is etched to extend the row lines 26 into the grid layer to the dielectric layer 27. This electrically isolates each of the row lines 26 from one another. In optional step 126, the dielectric 27 around the emitters 30 may be etched to further expose the emitters 30.

Although specific embodiments of, and examples for, the invention are described herein for illustrative purposes, various equivalent modifications can be made without departing from the spirit and scope of the invention, as will be recognized by those skilled in the relevant art. The teachings provided herein of the invention can be applied to other matrix-addressable circuits, not necessarily the exemplary field emission display generally described above. For example, the invention can be applied to matrix-addressable memory circuits or arrays.

These and other changes can be made to the invention in light of the above detailed description. In general, in the following claims, the terms used should not be construed to limit the invention to the specific embodiments disclosed in the specification and the claims, but should be construed to include all circuits that operate in accordance with the claims, and methods for manufacturing such devices. Accordingly, the invention is not limited by the disclosure, but instead its scope is to be determined entirely by the following claims.

What is claimed is:

1. A circuit structure for driving a matrix addressable device, comprising:

a row line having a nominal row width perpendicular to a longitudinal dimension of the row line and having a row input to receive a row driving signal;

a column line having a nominal column width perpendicular to a longitudinal dimension of the column line and having a column input to receive a column driving signal, the column line crossing the row line at a crossing location; and at least one of the row line and the column line having at least one window formed therein, the window having a window length in a dimension perpendicular to the width of the line in which the window is formed, the window length being greater than the nominal width of the line which it crosses such that the window overlaps the line that it crosses.

2. The circuit structure of claim 1 wherein the matrix addressable device is a field emission device, the column line is electrically coupled to an emitter and the row line is electrically coupled to an extraction grid having a gate proximate the emitter.

3. The circuit structure of claim 1 wherein each of the row line and column line have at least one window formed therein.

4. The circuit structure of claim 1 wherein the matrix addressable device is a matrix addressable display.

5. The circuit structure of claim 1 further comprising:

a dielectric separating at least a portion of the row line from the column line.

6. The circuit structure of claim 1 wherein each of the row line and column line have a window formed at the crossing location, the windows of the row line and column line overlapping at four junctions.

7. The circuit structure of claim 1 wherein the row line has at least one window formed therein.

8. The circuit structure of claim 7, further comprising:

a conductive silicon layer covering at least a portion of the window in the row line and electrically coupled to the row line.

9. The circuit structure of claim 7, further comprising:

a conductive silicon layer filing in at least a portion of the window in the row line and electrically coupled to the row line.

10. The circuit structure of claim 1 wherein the column line has at least one window formed therein.

11. The circuit structure of claim 10, further comprising:

a conductive silicon layer overlaying at least a portion of the window in the column line and electrically coupled to the column line.

12. The circuit structure of claim 10, further comprising:

a conductive silicon layer filing in at least a portion of the window in the column line and electrically coupled to the column line.

13. A circuit structure for driving a matrix addressable device, comprising:

a row line having a nominal width;

a column line having a nominal width, the column line overlapping the row line;

an area of overlap of the column line and the row line; and at least one of the column line and the row line having an opening formed therein, the opening having an opening length in a dimension perpendicular to the nominal width of the line in which the opening is formed, the opening length being greater than the nominal width of the line which it crosses such that the opening overlaps the line that it crosses.

14. The circuit structure of claim 13 wherein the row line has an opening formed therein at the area of overlap.

15. The circuit structure of claim 14, further comprising:

a semiconductive layer covering at least a portion of the opening in the row line and electrically coupled to the row line.

16. The circuit structure of claim 13 wherein the column line has an opening formed therein at the area of overlap.

17. The circuit structure of claim 16, further comprising:

a semiconductive layer covering at least a portion of the opening in the column line and electrically coupled to the column line.

18. The circuit structure of claim 16 wherein both the row line and the column line have an opening formed therein at the area of overlap.

19. A circuit structure for driving a field emission device, comprising:

a plurality of row lines;

a plurality of column lines spaced from and crossing the row lines at intersection points, each of the column lines having a number of windows formed therein, the windows being spaced along the column line such that the row lines are aligned with respective ones of the windows in the column lines, a length of the windows in the column lines being greater than a width of the row lines such that the windows in column lines overlap the row lines at the points of intersection;

a number of emitters coupled to each of the column lines; and a number of extraction grids, each of the extraction grids being coupled to one of the row lines and being positioned proximate respective ones of the emitters.

20. The circuit structure of claim 19, further comprising:

a number of emitter pads, each of the emitter pads disposed across a respective window in the column lines and supporting at least one of the emitters to electrically couple the emitter to the column line.

21. The circuit structure of claim 20 wherein the extraction grids comprise a number of apertures formed in the row line and aligned with the respective ones of the emitters.

22. The circuit structure of claim 20 wherein the column lines are metal.

23. The circuit structure of claim 22 wherein the emitter pads are pads of a semiconductor.

24. The circuit structure of claim 19 wherein each of the row lines has a number of windows formed therein, the windows being spaced along the row line and aligned with the windows in the column line.

25. The circuit structure of claim 24 wherein a length of the windows in the row line is greater than a width of the column lines such that the windows in row lines overlap the column lines at the intersection points.

26. The circuit structure of claim 24 wherein the extraction grids comprise:

a number of extraction strips, each of the extraction strips disposed across a respective window in the row lines to electrically couple the extraction strip to the respective row line and having at least one aperture formed therethrough proximate a respective one of the emitters.

27. The circuit structure of claim 26 wherein the extraction strips are strips of a semiconductor.

28. The circuit structure of claim 26, further comprising:

a dielectric material separating the column lines and the emitter pads from the row lines and the extraction strips.

29. A field emission display, comprising:

a plurality of row lines, each of the row lines having a number of windows formed therein, the windows being spaced along the row line;

a plurality of column lines spaced from and crossing the row lines such that the column lines are aligned with respective ones of the windows in the row lines, a length of the windows in the row line being greater than a width of the column lines such that the windows in row lines overlap the column lines;

a number of emitters coupled to each of the column lines;

a number of extraction grids, each of the extraction grids being coupled to one of the row lines and being positioned proximate respective ones of the emitters;

an anode positioned opposite the emitters; and a cathodoluminescent layer coating a surface of the anode facing the emitters.

30. The circuit structure of claim 29, further comprising:

a number of emitter pads, each of the emitter pads disposed across a respective window in the column lines and supporting at least one of the emitters to electrically couple the emitter to the column line.

31. The circuit structure of claim 29 wherein each of the column lines has a number of windows formed therein, the windows being spaced along the column line and aligned with the windows in the row line.

32. The circuit structure of claim 31, further comprising:

a number of emitter pads, each of the emitter pads disposed across a respective window in the column lines and supporting at least one of the emitters to electrically couple the emitter to the column line.

33. The circuit structure of claim 31 wherein a length of the windows in the column line is greater than a width of the row lines such that the windows in column lines overlap the row lines.

34. The circuit structure of claim 33, further comprising:

a number of emitter pads, each of the emitter pads disposed across a respective window in the column lines and supporting at least one of the emitters to electrically couple the emitter to the column line.

35. A method of forming a drive circuit for an addressable matrix device, comprising:

forming a row line on a substrate;

forming a column line spaced from the row line and crossing the row line at an intersection point;

forming windows in the row line, the windows having a length greater than a width of the column line such that the windows in the row line overlap the column line at the intersection point; and locating a dielectric between at least a portion of the row line and a portion of the column line.

36. The method of claim 35, further comprising:

forming a semiconductor layer covering at least a portion of the windows in the row line, the semiconductor layer electrically coupled to the row line.

37. The method of claim 35 wherein the step of forming the column line comprises:

forming a column line having a plurality of windows from a conductive material, the windows in the column line aligned with the windows on the row lines.

38. The method of claim 37, further comprising:

positioning a respective one of a number of memory elements proximate each set of aligned windows;

electrically coupling a first terminal of the memory element to the row line; and electrically coupling a second terminal of the memory element to the column line.

39. The method of claim 35, further comprising:

forming a semiconductor layer covering at least a portion of the windows in the row line, the semiconductor layer electrically coupled to the row line; and electrically coupling a number of emitters to the row line through the semiconductor layer.

40. The method of claim 39 wherein the step of forming the column line comprises:

forming a column line having a plurality of windows from a conductive material; and forming a semiconductor layer covering at least a portion of the windows in the column line and electrically coupled to the column line, the semiconductive layer having a plurality of apertures, the apertures aligned with respective ones of the emitters.

41. A method of forming a drive circuit for an addressable matrix display, comprising:

providing a substrate;

forming a number of conductive column lines on the substrate, the column lines each having a number of windows spaced therealong;

forming a number of semiconductor emitter pads at least partially covering each of the windows in the column lines;

forming a number of emitters on the emitter pads;

forming a number of semiconductor extraction grids proximate the emitters;

forming a number of conductive row lines spaced from and crossing the column lines at crossing points, each of the row lines electrically coupled to a respective one of the extraction grids and aligned with windows of the column lines, the row lines having widths less than lenghts of the windows such that the windows overlap the row lines at the crossing points; and forming a dielectric layer separating the column lines and emitters from the row lines and extraction grids.

42. The method of claim 41 wherein forming a number of conductive column lines on the substrate comprises depositing a column metal layer on the substrate; and patterning the column metal layer to form the column lines and the windows, the windows having a length greater than a width of the row lines.

43. The method of claim 41 wherein forming a number of conductive column lines on the substrate comprises depositing a column metal layer on the substrate; and patterning the column metal layer to form the column lines and the windows.

44. The method of claim 43 wherein forming a number of semiconductor emitter pads comprises:

depositing a first semiconductor layer having a first doping over the column lines and substrate; and etching the first semiconductor layer to form the emitter pads.

45. The method of claim 44 wherein forming a number of emitters on the emitter pads comprises:

depositing a second semiconductor layer having a second doping over the first semiconductor layer; and etching the second semiconductor layer to form the emitters.

46. The method of claim 45 wherein etching the first semiconductor layer to form the emitter pads follows etching the second semiconductor layer to form the emitters.

47. The method of claim 45 wherein forming a number of semiconductor extraction grids comprises:

depositing a third semiconductor layer over the dielectric layer; and planerizing the third semiconductor layer to form a number of apertures aligned with and exposing the emitters.

48. The method of claim 47 wherein forming a number of semiconductor extraction grids further comprises:

patterning the third semiconductor layer to electrically isolate each extraction grid.

49. The method of claim 47 wherein forming a number of conductive row lines comprises:

depositing a row metal layer; and patterning the row metal layer to form the row lines.

50. The method of claim 47 wherein forming a number of conductive row lines comprises:

depositing a row metal layer; and patterning the row metal layer to form the row lines, each of the row lines having a number of windows spaced therealong, the windows of the row lines spaced to align with the windows of the column lines.

51. The method of claim 50 and further comprising:

patterning the third semiconductor layer to electrically isolate each extraction grid after patterning the row metal layer to form the row lines.

52. The method of claim 47 wherein forming a number of conductive row lines comprises:

depositing a row metal layer; and patterning the row metal layer to form the row lines, each of the row lines having a number of windows spaced therealong, the windows of the row lines having a length greater than a width of the column lines and being spaced to align with the windows of the column lines such that the windows of the row lines overlap the windows of the column lines at four junctions at the crossing points.

* * * * *